US008668559B2

(12) United States Patent
Bellis

(10) Patent No.: US 8,668,559 B2
(45) Date of Patent: Mar. 11, 2014

(54) RELATING TO COIN DISPENSING

(75) Inventor: David Bellis, Oldham (GB)

(73) Assignee: Innovative Technology Limited, Oldham (GB)

( * ) Notice: Subject to any disclaimer, the term of this patent is extended or adjusted under 35 U.S.C. 154(b) by 1327 days.

(21) Appl. No.: 11/814,627

(22) PCT Filed: Jan. 25, 2006

(86) PCT No.: PCT/GB2006/000249

§ 371 (c)(1),
(2), (4) Date: Apr. 24, 2008

(87) PCT Pub. No.: WO2006/079803

PCT Pub. Date: Aug. 3, 2006

(65) Prior Publication Data

US 2008/0261505 A1 Oct. 23, 2008

(30) Foreign Application Priority Data

Jan. 25, 2005 (GB) ..... 0501566.4
Feb. 1, 2005 (GB) ..... 0502040.9

(51) Int. Cl.
*G07D 1/00* (2006.01)

(52) U.S. Cl.
USPC ..... 453/33; 453/6; 453/49; 453/50; 453/52; 453/57

(58) Field of Classification Search
USPC ..... 453/50–52, 57, 6, 10, 12, 13, 33–35, 49
See application file for complete search history.

(56) References Cited

U.S. PATENT DOCUMENTS

| | | | | |
|---|---|---|---|---|
| 4,036,242 | A | 7/1977 | Breitenstein et al. | |
| 4,657,035 | A * | 4/1987 | Zimmermann | 453/3 |
| 5,326,312 | A | 7/1994 | Patroni et al. | |
| 6,059,650 | A * | 5/2000 | Stoltz et al. | 453/40 |
| 2005/0003750 | A1 * | 1/2005 | Inuki et al. | 453/57 |

FOREIGN PATENT DOCUMENTS

| | | |
|---|---|---|
| DE | 333 0441 | 8/1983 |
| EP | 0017610 | 3/1980 |
| EP | 0552615 | 7/1993 |

* cited by examiner

*Primary Examiner* — Jeffrey Shapiro
(74) *Attorney, Agent, or Firm* — Woodard, Emhardt, Moriarty, McNett and Henry LLP

(57) ABSTRACT

A mechanism for separating single coins from a plurality of coins provided within a coin dispensing apparatus. The mechanism comprises a housing defining a coin dispensing path, coin transport means for urging coins along the coin dispensing path; and first and second biased coin stripping members located adjacent each other and disposed successively in the coin dispensing path at an outlet of the coin dispensing mechanism. The first and second stripping members together comprise a double outlet gate and each member is movable independently of the other by each urged coin to effect, in use, alignment and stripping of coins being dispensed.

39 Claims, 6 Drawing Sheets

RELATING TO COIN DISPENSING

REFERENCE TO RELATED APPLICATIONS

The present application is a national stage of International Patent Application PCT/GB2006/000249, filed 25 Jan. 2006, which claims the benefit of Great Britain Patent Application Serial No. 0501566.4, filed 25 Jan. 2005 and Great Britain Patent Application Serial No. 0502040.9, filed 1 Feb. 2005 all of which are hereby incorporated by reference.

FIELD OF THE INVENTION

The present invention concerns improvements relating to coin dispensing, and more particularly, though not exclusively, to a coin dispensing hopper incorporating an improved dispensing mechanism for dispensing coins. The term "coin" is used in its broadest sense throughout this specification and encompasses not only monetary coins but also tokens, medals and other similar discoid bodies.

BACKGROUND OF THE INVENTION

A key function of coin dispensing hoppers (which are simply referred to as hoppers hereafter) is to extract single coins from a bulk of coins they retain within them, for example to dispense the coins from vending, gaming or change-giving machines. The prior art shows a variety of approaches to providing this coin extraction functionality. Many hoppers rely on a rotating, planar coin disk which, with the help of centrifugal forces, dispenses coins disposed on the coin disk from an outlet situated near the periphery of the coin disk. Examples of such prior art structures are discussed in greater detail below. An alternative approach involves the provision of a base plate and a rotating coin disk comprising several coin apertures. In such hopper structures, coins are generally held within the coin apertures of the coin disk, forced against a barrier by the movement of the coin disk and subsequently dispensed through peripheral openings in the coin disk. An example of a hopper that utilises a coin disk comprising coin apertures is described in UK Patent Application GB 2352862.

It is commonly known to load more than one denomination and/or value of coin into a single hopper. Hoppers that are capable of dispensing coins having a variety of shapes and sizes, referred to as universal hoppers herein, are advantageous since they allow vending machines to function with only a single hopper, saving manufacturing costs, hopper maintenance costs and space. It will be appreciated that vending machines comprising a universal hopper generally include means of identifying and sorting as appropriate the different kinds of coins dispensed from the hopper. Specifically, when different types of coins are present in a hopper, selection of a desired type of coin is achieved by extracting a single coin at a time, determining its type/value and then either accepting it if it is the desired value or recirculating it back into the hopper if it is not. Much prior art exists teaching different mechanisms for achieving sorting and identification, see U.S. Pat. No. 4,036,242 for example.

Although universal hoppers have great advantages, particularly since identifying and sorting extracted coins is an area of technology that is well evolved, they also have inherent difficulties associated with them.

The internal mechanisms of a universal hopper must be configured to dispense individually, quickly and reliably coins having a variety of diameters, thicknesses, and sometimes even shapes (not all coins are strictly discoid—they may, for example, also be hexagonal, heptagonal or octagonal). One of the biggest challenges that must be overcome is the specific requirement for coins to be dispensed individually which arises, for example, because most coin sorting and identifying mechanisms, i.e. the mechanisms generally located immediately downstream of a universal hopper, only work reliably when supplied with a stream of individual (single) coins. A key problem that is well documented in the prior art is that where a hopper's internal coin extraction mechanism is set up to extract coins of a comparatively greater thickness it is possible for two coins of a comparatively lower thickness to stack on top of each other to be dispensed in combination (i.e. not individually, as required) because they mimic the shape of a single thicker coin.

A great deal of prior art attempts to deal with the problem of stacks of two or more thinner coins mimicking a thicker coin in universal hoppers (hereinafter referred to as "the double coin problem"). However, it has been found that the double coin problem generally forces a compromise having to be struck between (i) the variety of coins that can be processed in a given hopper and (ii) the mechanical complexity, and hence associated cost and reliability, of the internal parts of the hopper. Universal hoppers that support a great variety of coin diameters, thicknesses and shapes generally require a large number of complex parts, particularly to deal with the double coin problem, and are thus expensive, whilst hoppers that have a simple, reliable and cost effective structure are generally limited to either a single dimension of coins or a very narrow range of coin sizes and shapes.

To show how the prior art has attempted to solve the double coin problem, and to illustrate that prior to the present invention there has been a trade-off between mechanical complexity and scope of coin support, a number of prior publications will now be discussed.

European Patent Publication EP 0017610 describes a device for separating single coins from a bulk of coins comprising thick coins of a large diameter and thin coins of a small diameter. The device is of the rotatable planar disk type discussed above. A first spring biased coin stripping arm is mounted above the coin disk at a height which allows the thick coins to pass underneath the first arm (when the coins are supported in a horizontal position on the coin disk) but prevents the passage stacks of two or more thick coins or the combination of a thick coin and a thin coin. When stacks comprising at least one thick coin come into contact with the leading edge of the first coin stripping arm, only the lowermost coin is allowed to pass underneath the arm, whilst upper coins are stripped off the lowermost coin and return to the coin disk to attempt a further pass of the first stripping arm.

It will be appreciated that when the device of EP 0017610 is loaded with thin coins having a thickness which is less than half that of the thick coins, it is possible for stacks of two or more thin coins to pass underneath, and thus downstream of, the first stripping arm. To prevent such stacks of comparatively thinner coins from being dispensed via its exit conveyor belt, the apparatus of EP 0017610 comprises a second coin stripping arm mounted above the coin disk, downstream of the first stripping arm. The second coin stripping arm is formed by two spring-biased arm parts having shapes that are specifically adapted to recognise the diameter of approaching coins: the second coin arm is caused to lift and allow the passage of thick, large diameter coins but not of stacks of small diameter coins. Thus the apparatus of EP 0017610 is capable of preventing the passage of stacks of thin coins on to its exit conveyer belt based on the assumption that thin coins have a smaller diameter than thick coins.

Clearly, EP 0017610 only offers a very limited solution to the double coin problem. The device of EP 0017610 must be configured precisely to correspond to the dimensions of the coins that are to be processed. Configuration applies not only to the respective heights of the first and second stripping arms but also to the specific length and shape of the various parts of the second stripping arm. Additionally, the solution of EP 0017610 is only applicable where thinner coins indeed have a smaller diameter than thicker coins, which is not given in many monetary systems around the world.

It is clear that, although EP 0017610 does support a limited amount of variation in coin dimensions, it does not completely fulfil needs in this respect. Nevertheless, what little flexibility EP 0017610 offers in terms of coin dimensions comes at a heavy price in the context of complexity of design. The device of EP 0017610 comprises a large number of small components and the structure of the second stripping arm in particular is complicated and sensitive. This in turn means that the device of EP 0017610 is expensive to manufacture and maintain and likely to be relatively vulnerable to faults and wear and tear.

A second solution proposed by the prior art is disclosed in DE 333 0441. Again, a planar coin disk structure configured for a two stage process of stripping to prevent the passage of coin stacks is envisaged. A first, rigid stripping arm performs an initial stripping function which is augmented by a second coin stripping arm downstream. The second coin stripping arm is formed as a row of balls which are resiliently mounted close above the coin disk. The balls are mounted at a height just greater than the thickness of the thinnest coins processed by the device and are deflected upwards by any passing single thick coins, in use, whilst stripping any stacks of coins that pass the first stripping arm.

The arrangement of DE 333 0441 is more versatile than that of EP 0017610 in that it does not rely on the premise that thick coins have a larger diameter than thin coins. Nevertheless, it requires painstaking calibration of the first and second stripping arms to take into account the specific dimensions of the range of coins that is processed. The distance between the balls, for instance, is dependent on the diameter of the processed coins. It will be appreciated that the need for calibration in turn has an effect on the level of maintenance required; faults are more likely to occur, particularly since margins are fine and moving parts are involved. There is also potential for coins to get wedged under the non-biased first stripping arm. Further, the row of balls acting as the second stripping arm in particular is expensive to manufacture and replace (as would be necessary if the diameter of processed coins were to vary). In summary, whilst DE 333 0441 supports a greater variation in coin dimensions, it is possibly even harder to maintain, configure and manufacture, largely as a result of the row of balls.

A further prior art system, again having a planar coin plate structure is disclosed in U.S. Pat. No. 4,657,035. Here a second stripping system comprising a narrow stripping arm and a conveyor belt is employed downstream of a first coin stripper. The narrow stripping arm diverts the lowermost coin in any stack towards the coin exit of the device whilst the conveyer belt acts to force any superposed coins away from the exit, thus stripping them away.

The provision of a conveyer belt to disrupt any stacks of coins that progress past the first coin stripper of U.S. Pat. No. 4,657,035 provides a solution to the problem of double coins irrespective of coin diameter. However, once again, careful calibration of the entire device is necessary in response to the specific size of the coins that are to be processed. Additionally, the second stripping system, although flexible in terms of the dimensions of input coins is mechanically complex since it requires a drive mechanism and belt. This mechanical complexity, coupled with the need for precise calibration makes the device of U.S. Pat. No. 4,657,035 particularly susceptible to faults and expensive to maintain and produce. The complexity of the device of U.S. Pat. No. 4,657,035 is increased further by the fact that the relatively simple structure of the narrow stripping arm itself leads to the need for an additional closing element that stops small diameter coins from being dispensed in the slip stream of larger coins.

In summary, the prior art does not disclose a truly satisfactory (i.e. simple, effective and reliable) solution to the double coin problem. Prior art devices are all either inflexible in their intake of coins or highly complex, or both. Furthermore, most prior art devices must be carefully configured to match the coins that they are to process, which in turn leads to high maintenance costs and greater fault vulnerability. Finally it is noted that the vast majority of prior art solutions for the double coin problem are only suitable for use in planar coin disk type hoppers. Thus hoppers that rely on a coin disk with apertures cannot at present be equipped with a system that would allow them to function effectively as universal hoppers, which are required to dispense a wide variety of coins individually. The prior art solutions to the double coin problem require too much space in order to work effectively in combination with a hopper relying on a coin disk with coin apertures.

It is an object of the invention to overcome at least one of the problems associated with prior art hoppers or coin dispensing mechanisms.

SUMMARY OF THE INVENTION

From a first aspect, the present invention broadly resides in a mechanism for separating single coins from a plurality of coins provided within a coin dispensing apparatus, the mechanism comprising: a housing defining a coin dispensing path, coin transport means for urging coins along the coin dispensing path; and first and second biased coin stripping members located adjacent each other and disposed successively in the coin dispensing path at an outlet of the coin dispensing mechanism, the members together comprising a double outlet gate with each member being movable independently of the other by each urged coin to effect, in use, alignment and stripping of coins being separated. The term "outlet of the coin dispensing mechanism" in this context refers to a point of the mechanism at which the single coins are separated from the plurality of coins.

The mechanism according to the first aspect of the invention provides an effective and mechanically simple solution to the double coin problem. It can be applied to coins of any size or shape but is yet less mechanically complex than prior art solutions. Further, the mechanism according to the first aspect of the invention is very compact and may therefore be combined with a wide variety of hopper types.

To maximize the efficiency of the coin strapping members, the coin transport means may optionally be arranged to urge coins along the coin dispensing path whilst the coins are in contact with the first and second stripping members. For maximum effect, the coin transport means may, for example, urge the coins by actively pushing them at a position opposed to the leading face of the urged coins.

Advantageously, the coin transport means may further comprise a rotatable disk containing one or more coin-retaining apertures, the disk being provided adjacent a coin source for filling the or each aperture; and a deflecting member arranged to divert, in use, coins located in the or each aperture along the coin dispensing path. Such an arrangement may optionally further comprise a motor arranged to drive the rotatable disk. Further, the transport means may preferably comprise urging means on the rotatable disk, the urging means being arranged to cooperate with the deflecting member to urge a coin located in a coin-retaining aperture along the coin dispensing path by rotation of the disk. The urging means and the deflecting member may, for example, comprise complementary meshed formations enabling continuous relative rotational movement between the urging means and the deflecting member.

To allow it to contribute to the solution of the double coin problem, the deflecting member may be arranged to contact only one coin at a time, in use, and/or to divert only one coin at a time, in use.

To prevent a coin jam, the deflecting member may be spring biased and movable into a retracted position. The deflecting member may, for example, be pivotable about an elongate pin between a deflecting position and the retracted position. Such an arrangement represents a particularly effective and efficient solution to the problem of coin jams.

Advantageously, the first stripping member may be provided to block the coin dispensing path and comprise a first coin contacting surface that is arranged, in use, to translate an urging force of an urged coin into a displacement force that displaces the first stripping member out of the coin dispensing path. The first coin contacting surface may preferably be tapered and arranged, in use, to engage urged coins travelling along the coin dispensing path.

Preferably, the first stripping member may have an arcuate shape and the tapered first contacting surface may have a concave shape.

Additionally or alternatively, the second stripping member may preferably be provided to block the coin dispensing path and comprise a second contacting surface that is arranged, in use, to translate an urging force of an urged coin into a displacement force that displaces the second stripping member out of the coin dispensing path. The second contacting surface may, for example and advantageously, be tapered and arranged, in use, to engage urged coins travelling along the coin dispensing path which have cleared the first stripping member.

Preferably the second stripping member may have an arcuate shape and the tapered second contacting surface may have a concave shape.

For ease of adjacent mounting the shapes of the first and second stripping members may complement each other.

Conveniently, the first and second stripping members may each comprise respective first and second ends and may be held in place by spring biased support posts mounted at their respective first and second ends.

To contribute to the biased nature of the stripping members, the first and second stripping members may comprise a flexible material chosen from the group of: metals, polymers, and carbon fibre.

The coin mechanism according to the first aspect of the invention may advantageously be incorporated in coin hoppers and vending machines.

According to a second aspect of the invention, there is provided a coin dispensing mechanism for use in dispensing single coins from a plurality of coins provided within a coin dispensing apparatus, the mechanism comprising; a motor-driven rotatable disk containing a plurality of coin-retaining apertures; the disk being provided adjacent a coin source for filling the apertures; a coin outlet provided adjacent a side of the disk in operative co-operation with the plurality of apertures in use; an urging member arranged to divert a first single coin located in one of the plurality of apertures in a radial path to the coin outlet; and a resiliently biased displaceable door, closing the coin outlet until the door is engaged and opened by an edge of a coin being diverted; the coin then in use being urged past the door; whereby the urging member and the door are arranged to prevent a second or subsequent coin from passing the door simultaneously with the first coin.

According to a third aspect of the present invention there is provided a coin dispensing apparatus for dispensing single coins from a plurality of coins, the apparatus comprising: a coin source; a motor driven rotatable disk containing a plurality of coin retaining apertures; means for feeding coins from the source into the plurality of apertures; a coin outlet provided adjacent a side of the disk in operative co-operation with the plurality of apertures in use; an urging member arranged to divert a first single coin located in one of the plurality of apertures in a radial path to the coin outlet; and a resiliently biased gating member, gating the coin outlet until the gating member is engaged and lifted by an edge of a coin being diverted; the coin then in use being urged past the gating member; whereby the urging member and the gating member are arranged to prevent a second or subsequent coin from passing the gating member simultaneously with the first coin.

The term singulator is used herein to refer to the resiliently biased door or gating member mentioned above.

Preferably, means are provided to identify accurately different types of coins, and therefore their respective values, by their diameters so that a plurality of different types of coins can be additionally accrued to achieve a predetermined pay out total.

The ability to accrue a collection of different coins which have a value equal to a predetermined pay out total is possible due to use of the improved dispensing mechanism which ensures that only one coin, irrespective of its diameter or thickness, is dispensed at a time from the hopper.

BRIEF DESCRIPTION OF THE DRAWINGS

Methods and apparatus according to the presently preferred embodiment of the invention will now be described by way of example, with reference to the accompanying drawings in which.

DETAILED DESCRIPTION OF THE PRESENTLY PREFERRED EMBODIMENT

Figure 1:
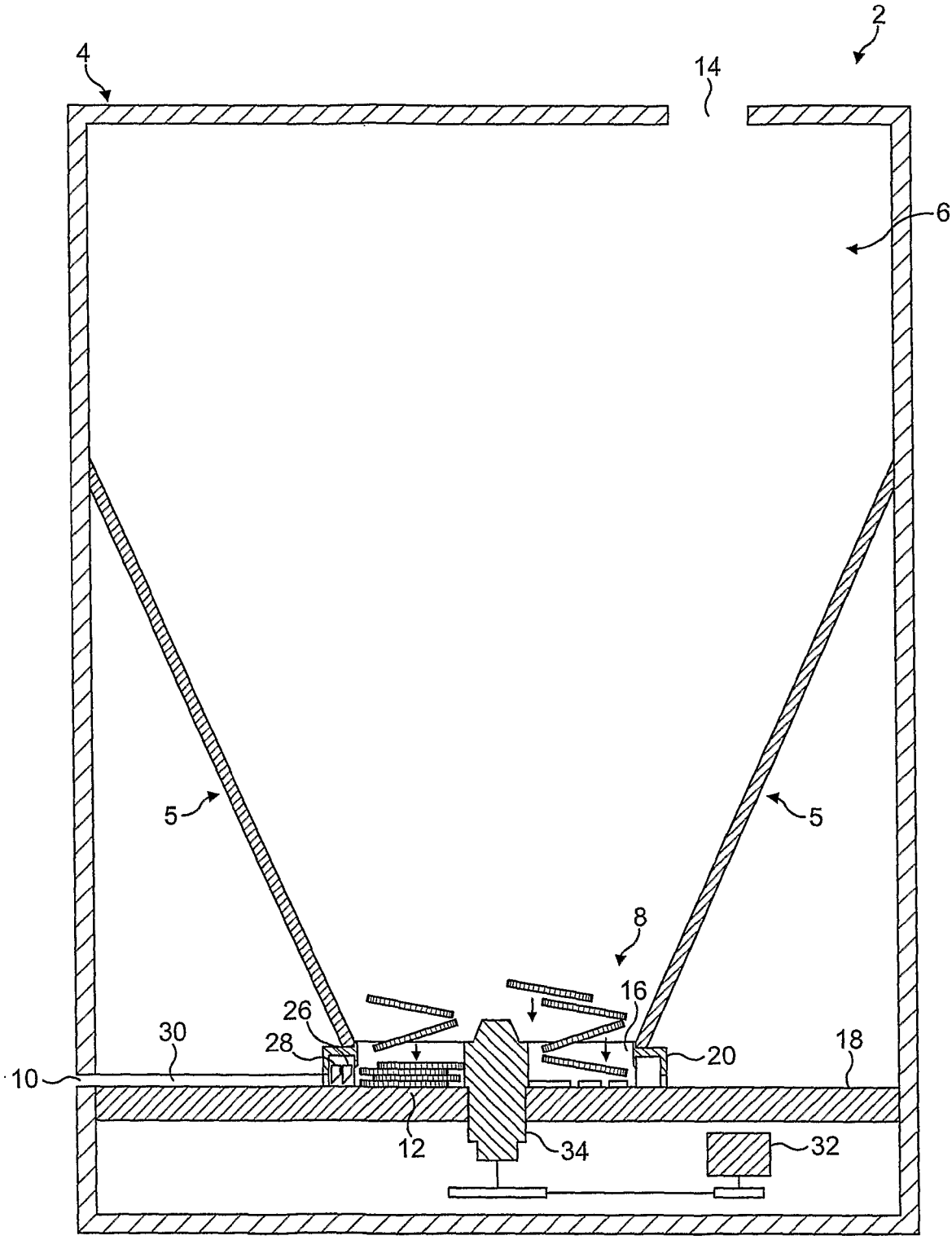
FIG. 1 is a sectional side view of a hopper comprising a coin dispensing mechanism, according to a first embodiment of the invention.

Referring firstly to FIG. 1, there is shown a coin dispensing hopper 2 comprising a housing 4, a coin store 6 for holding a bulk of coins, a coin dispensing mechanism 8 for separating and dispensing single coins from the bulk of coins, and a coin exit 10 from which the single coins are dispensed.

The coin store 6 is defined by the housing 4 and is essentially bowl shaped. It comprises a number of side walls 5 and a lower surface 12 towards which the bulk of coins held by the coin store 6 is drawn by gravity if the hopper 2 is positioned in its intended orientation. To allow the coin store 6 to be filled with a bulk of coins, the coin store 6 comprises a coin inlet 14 through which coins are provided.

The coin dispensing mechanism 8 is located on the lower surface 12 of the coin store 6 in order to be able to take in and process any coins that are provided in the coin store 6. Since the coins naturally fall to the bottom of the hopper 2, the coin dispensing mechanism 8 is always supplied with any coins that may be present in the coin store 6, provided that the hopper 2 is positioned in its intended orientation.

Any coins provided in the coin store 6 enter the coin dispensing mechanism 8 via a circular coin disk 16 of the coin dispensing mechanism 8. Further key components of the coin dispensing mechanism 8 are, with reference to FIGS. 1, 2 and 4: a base plate 18 that supports the coin disk 16 and other components; an annular, upstanding ridge structure 20 that surrounds the coin disk 16 but defines a coin passage 22 within the annular ridge structure for coins exiting the coin disk 16; a segmented diverting rib (diverter) 24 for deflecting coins, two singulators 26, 28 arranged within the coin passage 22 to prevent the dispensing of double coins, and a coin dispensing channel 30 which serves to lead single coins from the end of the coin passage 22 to the coin exit 10 of the hopper 2.

Figure 2:
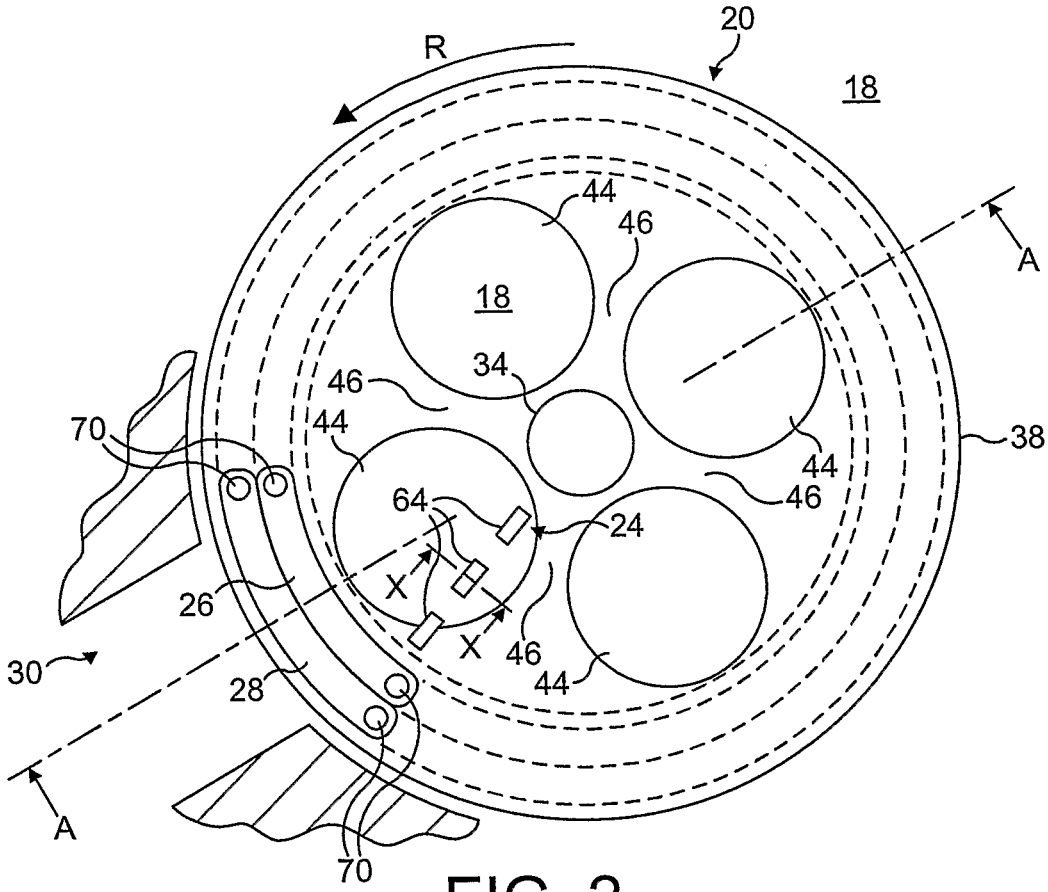
FIG. 2 is an enlarged, partially open top view, without coins, of the coin dispensing mechanism of the hopper of FIG. 1.
Figure 4:
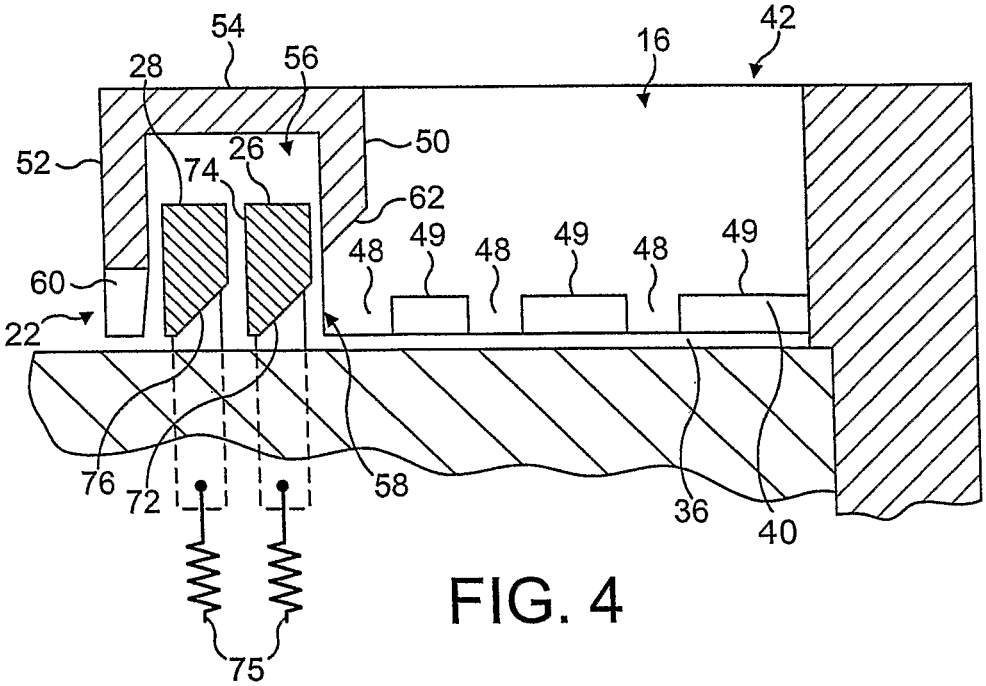
FIG. 4 is a partial sectional view along an imaginary line A-A indicated in FIG. 2.
Figure 5A:
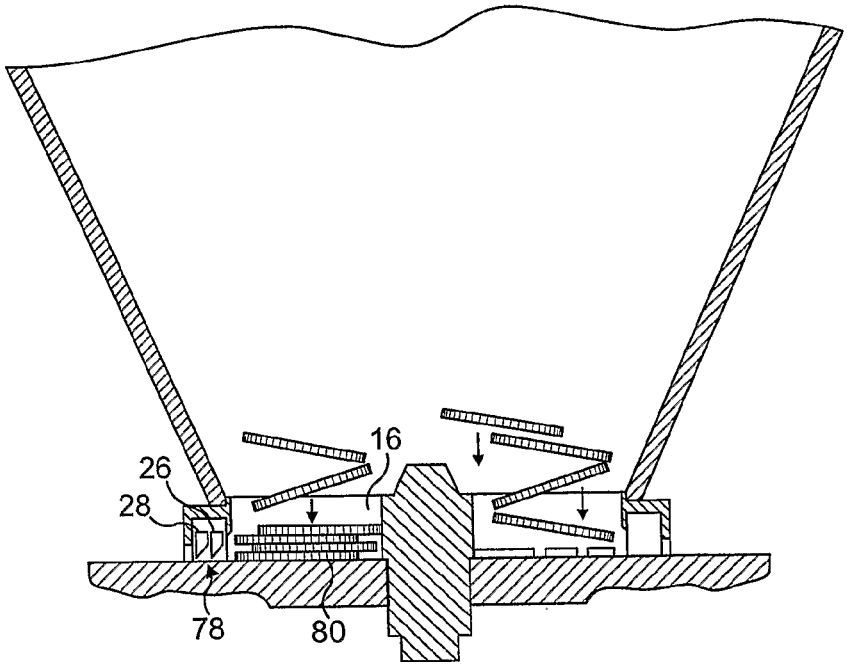
FIGS. 5*a* to 5*f* are a series of operational sectional views of the coin dispensing mechanism of FIG. 2, including aligned coins.
Figure 5B:
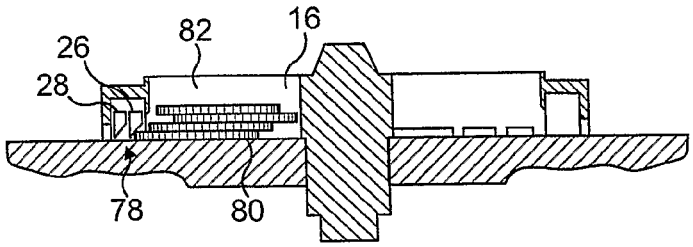
Figure 5C:
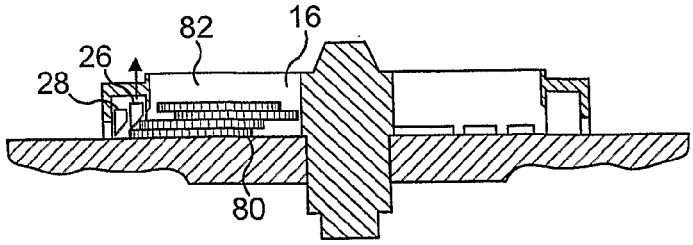
Figure 5D:
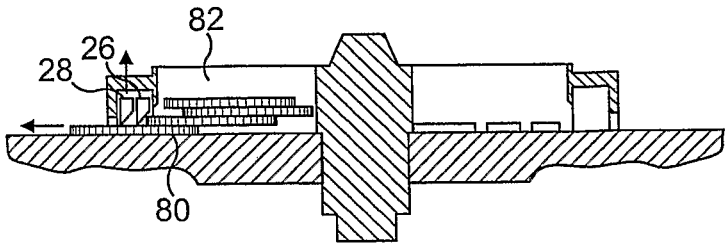
Figure 5E:
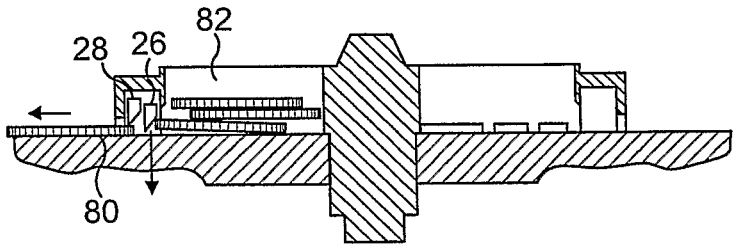
Figure 5F:
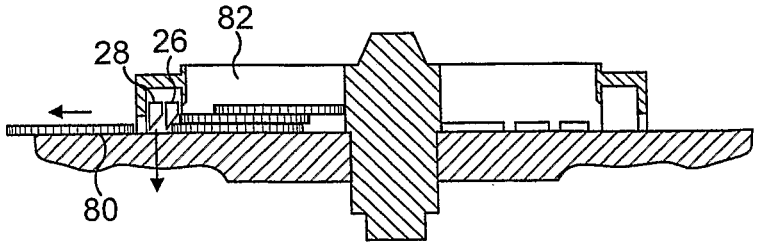

A detailed view of the structure of the coin mechanism's coin disk 16 is provided in FIGS. 2 and 4. The coin disk 16 is supported above the base plate 18 (which in this embodiment is integral with the lower surface 12 of the coin store 6) and is operatively linked to a motor 32 via a central axis 34 extending through the base plate 18. The gap 36 between the coin disk 16 and the base plate 18 is marginally greater than the thickness of the thickest coin that is to be processed by the hopper 2.

The coin disk 16 comprises an outer edge 38, a lower surface 40 facing towards the base plate 18, an upper surface 42 facing away from the base plate 18, and four equally spaced, circular apertures 44 having a diameter slightly greater than the diameter of the largest coins to be processed by the hopper 2. Each of the apertures 44 extends from the upper surface 42 through to the lower surface 40 of the disk 16 and thus, in the absence of coins, the base plate 18 is visible through the coin disk 16 via the apertures 44, in the view of FIG. 2. Referring still to FIG. 2, since the apertures 44 in the disk 16 are equally spaced, they give rise between them to four equally spaced bridges 46 where, on its upper surface 42, the coin disk 16 extends continuously from the central axis 34 to its outer edge 38.

Referring to FIG. 4, on the lower surface 40 of the coin disk 16 four segmented transport ribs 48 extend radially from the region of the central axis 34 up to the outer edge 38 of the coin disk. The transport ribs 48 extend along the centre of the bridges 46 between the circular apertures 44 and, unlike the lower surface 40 of the coin disk 16 which is at a height greater than the thickest coin, project almost up to the base plate 18. Each of the transport ribs 48 comprises three gaps 49 and thus has a comb shape that is complementary with the segmented diverting rib (diverter) 24 which projects from the base plate 18 towards the coin disk 16 and is described further below. The three respective gaps 49 of each transport rib are arranged to be at first, second and third radii from the central axis 34 so that they define first, second and third annular channels in the coin disk 16 surrounding the central axis 34 at the first, second and third radii.

In use, coins from the coin store fall into the circular apertures 44 of the coin disk 16, which is rotated by the motor 32 in a counter clockwise direction R. The transport ribs 48 on the lower surface 40 of the coin disk 16 assist in pushing along the lowermost coins held within the apertures 44 of the coin disk 16, i.e. those coins resting on the base plate 18 that would otherwise pass underneath the lower surface 40 of the coin disk 16. Any coins that are stacked on the lowermost coins and extend into the apertures 44 of the coin disk 16 are pushed along by the borders of the apertures 44.

As mentioned above, the base plate 18 supports not only the rotatable coin disk 16 but also a number of other components. In particular, it carries the annular ridge structure 20 that surrounds the coin disk 16, the segmented diverting rib (diverter) 24, and two singulators 26, 28.

The annular ridge structure 20 enables coins to be held underneath the coin disk 16 during rotation of the disk 16. In particular, the ridge structure 20 counteracts the centrifugal forces experienced by coins as the coin disk 16 rotates and ensures that coins are only dispensed via a single outlet 22. A secondary function of the ridge structure 20 is that it houses the singulators 26, 28, which are described in detail below.

As illustrated in FIGS. 2 and 4, the annular ridge structure 20 immediately surrounds the outer edge 38 of the coin disk 16 and projects to approximately the same height as the coin disk 16. The ridge structure 20 comprises inner and outer annular, concentric walls 50, 52 which project substantially perpendicularly from the base plate 18, and an upper wall 54 which is substantially parallel to the base plate 18 and connects the inner and outer walls 50, 52 at their upper ends, i.e. the ends facing away from the base plate 18. The three walls 50, 52, 54 of the ridge structure 20 define, within the ridge structure 20, an annular chamber 56 that is concentric with the coin disk 16.

The inner wall 50 of the ridge structure 20, which is immediately adjacent to the outer edge 38 of the coin disk 16, generally prevents radially outward movement of coins that are driven by the coin disk 16. However, the inner wall 50 comprises a sole coin outlet gap 58 which allows the controlled passage, through the inner wall 50, of coins which are propelled radially outwards from the coin disk 16. A further corresponding outlet gap 60 is formed in the outer wall 52 of the ridge structure 20 so that a coin passage 22, leading radially outwards from the coin disk 16, across the chamber 56, is defined.

The coin outlet gap 58 of the inner wall 50 is sized so as to allow the passage of coins resting in a flat position on the base plate 18 through the coin passage 22. The size of the coin outlet gap 58 is defined by the size of a portion of the inner wall 50 of the ridge structure 20 which extends from the upper wall 54 of the ridge structure 20 towards the base plate 18. The lower edge 62 of this inner wall portion, i.e. the edge facing the coin outlet gap 58, has a tapered edge to help avoid the problem of coins getting jammed between the inner wall 50, the coin disk 16 and the base plate 18 in use. The coin outlet gap 60 in the outer wall 52 has similar dimensions to the outlet gap 58 of the inner wall 50 but does not comprise tapered edges.

Turning now to the mechanism by which coins are radially propelled from the coin disk 16 into the coin passage 22 defined by the ridge structure 20, it will be appreciated that centrifugal forces are an important contributory factor. However, in order to provide the strong urging force desirable for the spring-biased singulators 26, 28 to perform a stripping function as described below, the coin dispensing mechanism 8 comprises a spring-biased diverter 24 that actively diverts coins from the coin disk 16 into the coin passage 22.

With reference to FIG. 2, the spring-biased elongate diverter 24 comprises first, second and third plastic segments 64 which, in their biased position, are arranged to protrude from the base plate 18, underneath the coin disk 16 respectively along a line extending radially from the central axis 34 towards the coin passage 22. Specifically, the segments 64 are arranged such that they deflect outwards, into the coin passage 22, coins which have fallen into the apertures 44 of the coin disk 16 and are being forced to slide along the base plate 18 in a circular motion by the action of the transport ribs 48 of the coin disk 16. The diverter 24 protrudes to a height that is lower than the thickness of the thinnest processed coin. As a result, only lowermost coins in a stack of coins held in an aperture 44 of the coin disk 16 are generally deflected into the passage 22 by the diverter 24.

There is no interference between the segments 64 of the diverter and the transport ribs 48 of the coin disk 16 since, as mentioned above, the diverter 24 and the transport ribs 48 are complementary: the first, second and third segments 64 of the diverter 24 project at positions corresponding to the first, second and third annular channels defined by the transport ribs 48. Equally, the gaps between the first second and third projecting segments 64 of the diverter 24 correspond to the raised sections of the transport ribs 48. In the absence of coins, the diverter 24 and the transport ribs 48 are therefore able to pass each other freely upon rotation of the coin disk 16. When coins are present, the transport ribs 48 and the diverter 24 combine to urge/propel them into the coin passage 22 in the ridge structure 20 as mentioned above.

Figure 3A:
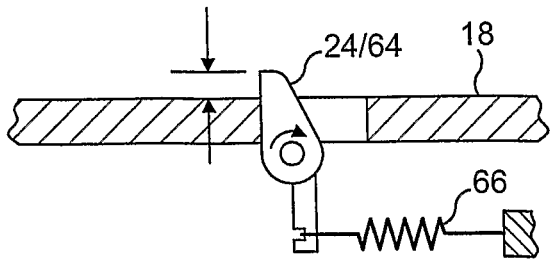
FIG. 3*a* is a partial sectional view along an imaginary line X-X indicated in FIG. 2.
Figure 3B:
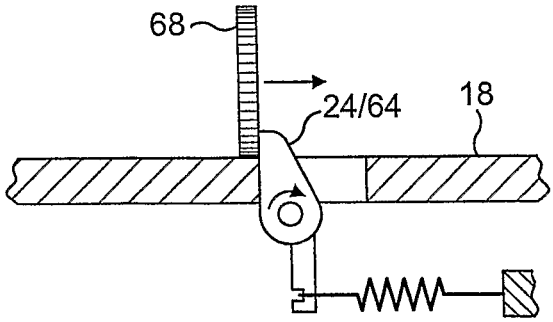
FIG. 3*b* is the same view as FIG. 3*a* further including a vertical coin to illustrate coin jamming.

Referring now to FIG. 3*a*, the segments 64 of the diverter 24 are joined together under the surface of the base plate 18 and are biased by a single spring 66 embedded within the base plate 18. The spring 66 acts to pivot the diverter into a protruding condition about an elongate pin but also allows it to pivot to a retracted position under the application of a sufficiently large force. The spring 66 is arranged to allow the entire diverter 24 to be pushed into a position where the diverter is flush with the surface of the base plate 18. FIG. 3*b* illustrates how the spring bias of the diverter 24 avoids the problem of coin jams between the diverter 24 and the rotating coin disk 16, for instance because a coin 68 falls into a coin aperture 44 in a substantially vertical position, rather than in a flat position. The spring bias of the diverter 24 is selected such that, although the diverter 24 can be pushed into its retracted position to avoid jamming, it is also capable of diverting coins resting flatly on the base plate 18 without the risk of retraction. This functionality is facilitated by the fact that the forces involved in a coin jam are considerably higher than those needed for deflection. As discussed below, the spring bias of the diverter 24 is also selected to be greater than that of the spring biased singulators 26, 28.

It will be appreciated that the components of the coin dispensing mechanism 8 described thus far are capable of collecting coins from the coin store 6 and transporting them, via the coin disk 16, the coin passage 22 and the coin dispensing channel 30 to the coin exit 10 of the hopper 2. However, the hopper 2 of this embodiment has the additional functionality of being able to guarantee that coins are dispensed one at a time and not in stacks, as would occasionally occur without further components.

To this end, the coin mechanism 8 of the hopper 2 comprises, with reference to FIGS. 2 and 4, as further components supported by the base plate 18, inner and outer resiliently biased gating members 26 and 28 (referred to as inner and outer singulators or coin stripping members herein). The inner and outer singulators 26, 28 are oblong and arcuate in shape and are mounted, with the help of spring-biased supporting posts 70, within the annular chamber 56, between the outlet gaps 58, 60 formed in the inner and outer walls 50, 52 of the ridge structure 20, perpendicularly to, i.e. across, the coin passage 22. Both singulators 26, 28 of the embodiment are formed of a flexible metal.

The inner singulator 26 has a concave inner surface 72, a convex outer surface 74, upper and lower surfaces, and first and second ends. The first and second ends are biased towards to the base plate by supporting posts 70, which are biased by springs 75 embedded in the base plate 18. The force exerted by the springs 75 of the supporting posts 70 is less than that exerted by the spring 66 of the diverter 24; this is to prevent the diverter 24 from being deflected into its retracted position merely as a result of the resistance encountered due to the inner singulator 26. The same applies in respect of the outer singulator 28, which is also mounted with the help of spring biased posts 70, as discussed below.

In the absence of coins, the lower surface of the inner singulator 26 is held immediately adjacent to the base plate 18, whilst the concave inner surface 72 faces the coin disk 16 such that the singulator 26 is concentric with the inner and outer walls 50, 52 of the ridge structure 20. Since the curvature of the inner singulator 26 corresponds to the curvature of the annular ridge structure 20, the sinner singulator 26 fits lengthways into the annular chamber 56.

In the absence of coins, the inner singulator 26 is biased to block the entire width of the coin passage 22. However, to assist the inner singulator 26 with its function of allowing single coins to pass, a lower portion of the inner singulator's inner concave surface 72 is tapered in the direction of the base plate 18. The working of the inner singulator 26 to allow the passage of single coins is described in greater detail below.

The outer singulator 28 has a similar structure to the inner singulator 26 and is mounted in analogous fashion adjacent to the inner singulator 26, i.e. also across the coin passage 22 and with the help of spring biased posts 70. However the outer singulator 28 is slightly longer and slightly less curved than the inner singulator 26, and is mounted further towards the outlet gate 60 of the outside wall 52 of the ridge structure 20. Due to the slight difference in curvature between the outer and the inner singulator, the inner singulator's convex outward facing surface 74 fits the adjacent concave inward facing surface 76 of the outer singulator. In other words, the inner and outer arcuate singulators 26, 28 are mounted so as to be adjacent and concentric.

Like the inner singulator 26, the outer singulator 28 is also biased to block the coin passage 22 defined by the inner and outer walls 50, 52 of the ridge structure 20. The outer singulator's inner concave surface 76 is tapered in the direction of the base plate 18 to allow for the passage of single coins as described in greater detail below.

Any coins that pass the inner and outer singulators 26, 28 progress to the coin dispensing channel 30 of the hopper. The coin dispensing channel 30, which is defined by the housing 4 of the hopper, guides coins to the coin exit 10 of the hopper, from where they are dispensed.

Referring now to FIGS. 5*a* to 5*f*, the inner and outer singulators 26, 28 form a resiliently biased double gate 78 that controls the passage of coins through the coin passage 22 defined by the ridge structure 20. Specifically, the singulator double gate 78 only allows the passage of single coins which are supported on the base plate 18 in a flat configuration. Any superposed coins are stripped off and forced to wait so as to pass through the double gate individually.

As shown in the sequence of FIGS. 5*b* to 5*e*, the tapering of the inner surface 72 of the inner singulator 26 enables a single coin 80, which is supported in a flat position on the base plate 18 and is forced against the inner surface 72 by the action of the coin disk 16 and the diverter 24, to engage and lift the inner singulator 26 against the force of the biased supporting posts 70, thereby gaining passage past the first singulator 26. Similarly, with reference to FIGS. 5*d* to 5*f*, the single coin 80 is also able to lift the second singulator 28 due to the tapered inner surface 76 of the second singulator 28. In essence, in the case of a single coin 80, the tapered inner surfaces 72, 76 of the inner and outer singulators 26, 28 both act to translate some of the lateral force with which the coin 80 is pushed in the direction of the singulators 26, 28 into a perpendicular force that counteracts the bias of their respective singulator 26, 28 and thus opens the way for the single coin 80 to pass.

A key point of note is that even whilst a coin 80 passes the singulators 26, 28, it maintains a link to the lateral force exerted by the diverter 24 and the transport ribs 48 of the coin disk 16. Thus, the diverter 24 and the transport ribs 48 continue to urge the single coin 80 through the singulators 26, 28 even when it is already in contact with the singulators 26, 28. The single coin 80 does not rely solely on its own momentum to pass the singulators 26, 28: it is actively urged past the singulators by the coin disk 16 and the diverter 24.

Any number of subsequent single coins can pass the singulators 26, 28 in the manner described above. Furthermore, it follows from the above description of the diverter 24 and the coin disk 16 that, generally speaking, only a single coin 80 resting on the base plate 18 is actively urged towards the singulators 26, 28: the diverter 24 only protrudes above the base plate 18 by a height which is marginally lower than the thickness of the thinnest processed coin, and thus only engages the lowermost coin 80 in each aperture 44 of the coin disk 16. Nevertheless, the applicant has found that due to centrifugal forces and the friction between superposed coins 82 there are instances where stacks of two or more coins 80, 82 are urged towards the singulators 26, 28. In the absence of singulators 26, 28, such stacks of coins, 80, 82 would be as a whole. However, the singulators 26, 28 perform a compact and efficient stripping function that prevents the passage of stacks 80, 82 into the coin dispensing channel 30.

In cases where a stack of two or more coins 80, 82 is aligned, i.e. its coins are substantially parallel, the first singulator 26 allows the passage of the lowermost coin 80 of the stack in the manner described above. Superposed coins 82 however are not urged towards the singulator 16 with the same force as the lowermost coin because they are not in contact with the diverter 24, which only projects as high as the thickness of the lowermost coin. Therefore superposed coins 82 do not possess sufficient lateral force to displace the inner singulator 26 against its spring bias so as to allow them to pass simultaneously with the lowermost coin 80. However, after the lowermost coin 80 passes on its own, the superposed coin 80 immediately above it can drop to the level of the base plate 18 and thus benefits from the force applied by the diverter 24, allowing it to force open the singulator 26 and pass into the dispensing channel individually.

In summary, the double gate 78 of singulators 26, 28, in combination with the selective force exerted by the diverter 24 and the coin disk 16, ensures that multiple coins in aligned stacks 80, 82 cannot progress into the dispensing channel 30 simultaneously under any circumstances.

Figure 6A:
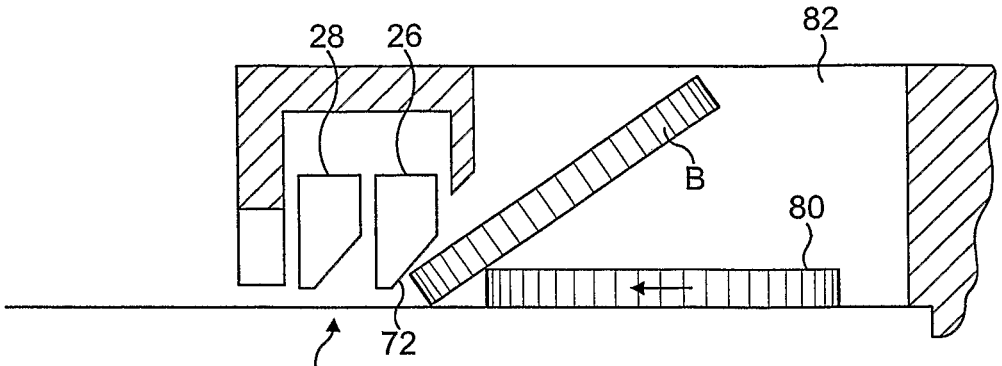
FIGS. 6*a* to 6*c* are a series of partial operational sectional views of the coin dispensing mechanism of FIG. 2, including unaligned coins.
Figure 6B:
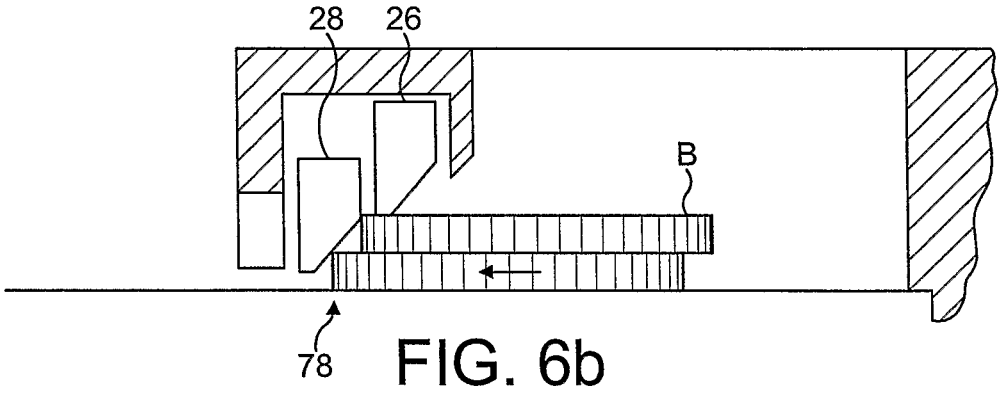
Figure 6C:
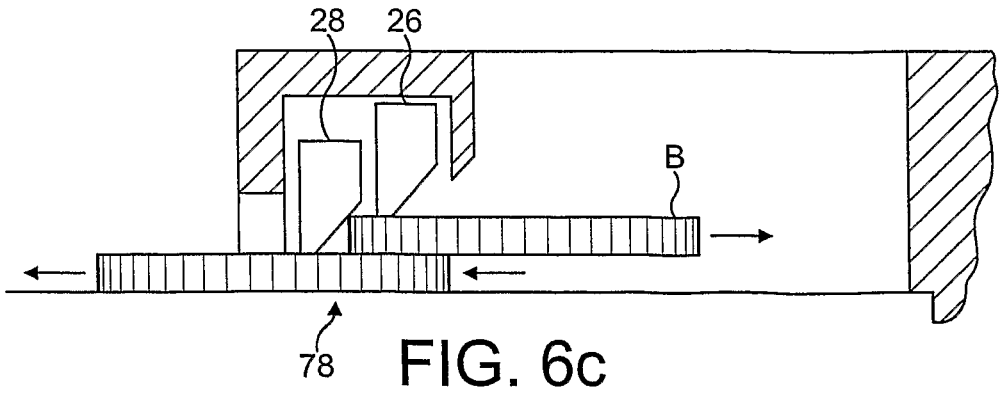

Referring now to FIGS. 6*a* to 6*c*, the applicant has found that, particularly when the coin disk 16 is operated at high speeds it is occasionally possible for stacks of coins 80, 82 to be forced towards the singulators in an unaligned configuration. This typically occurs when a superposed coin 82 is wedged between a lowermost coin 80 and the first singulator 26 as illustrated in FIG. 6*a*. In such cases, the superposed coin 82 is able to benefit from the force applied by the diverter 24 to the lowermost coin 80 and wedges itself past the inner singulator 26 together with the underlying coin 80, as shown in FIG. 6*b*.

To counteract the wedging action of unaligned coins, the spring bias and tapered inner surface 72 of the of the inner singulator 26 allow the inner singulator 26 to align the superposed coin 82 with the lowermost coin 80 as shown in FIG. 6*b*. Once alignment has occurred, the superposed coin 82 no longer directly benefits from the force applied by the diverter 24 to the lowermost coin 80 and is hence incapable of forcing the outer singulator 28 to open. Thus the double gate of singulators 78, in combination with the selective force exerted by the diverter 24 and the coin disk 16, ensures that multiple coins in unaligned stacks 80, 82 cannot progress into the dispensing channel 30 simultaneously under any circumstances.

The skilled person will appreciate that a number of modifications can be made to the preferred embodiment of the invention. The structure of the coin disk may, for instance, vary, as may the structure of the diverter. The coin disk may have more or less than four apertures, potentially even only a single aperture. Indeed, it is not even essential to the working of the singulators to employ an apertured coin disk as described; any transport means capable of actively urging only a lowermost coin towards the singulators is suitable for putting the singulators to use. The described apertured disc represents a particularly effective way of achieving this. However, the skilled person will appreciate that the specific components described in respect of the preferred embodiment may be used selectively, or in a variety of combinations depending on the intended function of the hopper.

For instance, in an alternative embodiment of the invention, a hopper comprises a coin dispensing mechanism broadly similar to that described above but wherein only one singulator is used to prevent the dispensing of double coins. In this alternative embodiment the problem of coin jamming is avoided by urging only aligned coins into the sole singulator. Unaligned stacks of coins are avoided, for example, by configuring the coin disk and the ridge structure appropriately, or by building in a separate aligning means.

The invention claimed is:

1. A mechanism for separating single coins from a plurality of coins provided within a coin dispensing apparatus from a coin source, the mechanism having an outlet and comprising:

a housing defining a coin dispensing path having an entry, coin transport means for urging coins along the coin dispensing path; the coin transport means including a rotatable disk containing a plurality of coin-retaining apertures, the disk being located adjacent a coin source for filling the apertures, and further including a deflecting member located to divert coins in sequence from the apertures into the entry of the coin dispensing path as the disk rotates ; and stripping means including first and second biased coin stripping members located adjacent each other and disposed successively in the coin dispensing path at an outlet of the coin dispensing mechanism, the members together comprising a double outlet gate with each member movable independently of the other by each urged coin to effect, in use, alignment and stripping of the coins as they are separated, and wherein the stripping means performing the function of locating the first stripping member in a position blocking the coin dispensing path, the first stripping member has a first coin contacting surface that is arranged, in use, whereby the stripping means performs the function to translate an urging force of an urged coin into a displacement force that displaces the first stripping member out of the coin dispensing path and the coin contacting surface is tapered and arranged, in use, to engage urged coins travelling along the coin dispensing path; and an urging means cooperating with the deflecting means creating the urging force to urge a coin located in a coin retaining aperture along the coin dispensing path by rotation of the disk.

2. The mechanism of claim 1, wherein the coin transport means is arranged to urge coins along the coin dispensing path whilst the coins are in contact with the first and second stripping members.

3. The mechanism of claim 1, further comprising a motor arranged to drive the rotatable disk.

4. The mechanism of claim 1, wherein the urging means and the deflecting member comprise complementary meshed formations enabling continuous relative rotational movement between the urging means and the deflecting member.

5. The mechanism of claim 1, wherein the deflecting member is arranged to contact only one coin at a time, in use.

6. The mechanism of any of claim 1, wherein the deflecting member is arranged to divert only one coin at a time in use.

7. The mechanism of any of claim 1, wherein the deflecting member is spring biased and is movable into a retracted position to prevent a coin jam.

8. The mechanism of claim 7, wherein the deflecting member is pivotable about an elongate pin between a deflecting position and the retracted position.

9. The mechanism of claim 1, wherein the first stripping member has an arcuate shape and the tapered first contacting surface has a concave shape.

10. The mechanism of claim 1, wherein the second stripping member is provided blocking the coin dispensing path, the second stripping member comprising a second contacting surface that is arranged, in use, to translate an urging force of an urged coin into a displacement force that displaces the second stripping member out of the coin dispensing path.

11. The mechanism of claim 10, wherein the second contacting surface is tapered and arranged, in use, to engage urged coins travelling along the coin dispensing path which have cleared the first stripping member.

12. The mechanism of claim 11, wherein the second stripping member has an arcuate shape and the tapered second contacting surface has a concave shape.

13. The mechanism of claim 1, wherein the shapes of the first and second stripping members complement each other.

14. The mechanism of claim 1, wherein the first and second stripping members each comprise respective first and second ends and are held in place by spring biased support posts mounted at their respective first and second ends.

15. The mechanism of claim 1, wherein the first and second stripping members comprise a flexible material chosen from the group of metals, polymers and carbon fibre.

16. A coin hopper comprising a coin dispensing mechanism according to claim 1.

17. A vending machine comprising a coin dispensing mechanism according to claim 1.

18. A coin dispensing mechanism for use in dispensing single coins from a plurality of coins provided within a coin dispensing apparatus, the mechanism comprising:

a motor-driven rotatable disk containing a plurality of coin-retaining apertures; the disk being provided adjacent a coin source for filling the apertures;

a housing having the disk rotatably mounted thereto, the housing having a coin dispensing path with a coin outlet provided adjacent a side of the disk in operative co-operation with the plurality of apertures in use;

urging means including an urging member arranged to perform the function of diverting in sequence a single coin located in each of the plurality of apertures in a radial path to the coin outlet as the disk moves the apertures in sequence past the coin outlet; and door means including a resiliently biased displaceable door with the door means performing the function of closing the coin outlet until the door is engaged and opened by an edge of a coin being diverted by the urging member and urged past the door; whereby the urging member and the door are arranged to prevent a second or subsequent coin from passing the door simultaneously with the first coin, the door having a coin contacting surface that is arranged, in use, to translate an urging force of an urged coin into a displacement force that displaces the door out of the radial path and the coin contacting surface is tapered and arranged, in use, to engage urged coins travelling along the radial path.

19. A coin dispensing mechanism according to claim 18, wherein the door means includes a further resiliency biased displaceable door with the door means performing the function of also closing the coin outlet until the further door is engaged and opened by an edge of a coin being diverted; the coin then in use also being urged past the further door, the further door being provided adjacent the resiliently biased displaceable door and being arranged to prevent a second coin from being dragged into the coin outlet by the first coin.

20. A coin dispensing mechanism according to claim 18, wherein the coin outlet and the resiliently biased displaceable door both have a curved profile matching a circumferential curvature of the disk.

21. A coin dispensing mechanism according to claim 19, wherein the further door has a curved profile matching the curvature of the resiliently biased displaceable door.

22. A coin dispensing mechanism according to claim 21, wherein each door is arranged to be moved orthogonally to the movement of a coin being dispensed and comprises an angled face providing a coin engaging surface for translating the movement of the coin to opening of the door.

23. A coin dispensing mechanism according to claim 18, wherein the door and/or further door are biased into position by at least one respective tensioned spring, and the door and/or further door are in use lifted against the action of the at least one tensioned spring by the leading edge of a coin being diverted.

24. A coin dispensing mechanism according to claim 23, wherein each door is held in their operating position by means of location pins along which the door can be displaced.

25. A coin dispensing mechanism according to claim 18, wherein the disk comprises a plurality of coin transporting ribs which in use engage the coin to push the same against the urging member as the disk is being rotated.

26. A coin dispensing apparatus according to claim 25, wherein the disk comprises a base plate having a plurality of slots provided therein, and the urging member comprises a plurality of upstanding ribs complementary to the plurality of slots.

27. A coin dispensing apparatus according to claim 18, wherein the urging member protrudes into the disk by an amount equal to or less than the thickness of the thinnest coin that the mechanism is designed to dispense.

28. A coin dispensing apparatus according to claim 18, wherein the urging member is spring biased into position and is arranged to be displaceable out of a coin engaging position in response to an abnormal force of a coin pushing thereon.

29. A coin dispensing apparatus for dispensing single coins from a plurality of coins, the apparatus comprising;

a coin source;

a motor driven rotatable disk containing a plurality of coin retaining apertures;

feeding means for feeding coins from the source into the plurality of apertures;

a coin outlet provided adjacent a side of the disk in operative co-operation with the plurality of apertures in use;

urging means arranged to divert in sequence a single coin located in each of the plurality of apertures in a radial path to the coin outlet as the disk rotates and moves the coin retaining apertures in sequence past the coin outlet; and a resiliently biased gating means including a gating member at the coin outlet, wherein the gating means performs the function of gating the coin outlet until the gating member is engaged and lifted by an edge of a coin being diverted by the urging means; the coin then in use being urged past the gating member; whereby the urging member and the gating member are to prevent a second or subsequent coin from passing the gating member simultaneously with the first coin, wherein the gating means performs the further function whereby the gating member having a coin contacting surface that is arranged, in use, to translate an urging force of an urged coin into a displacement force that displaces the gating member out of the radial path and the coin contacting surface is tapered and arranged, in use, to engage urged coins travelling along the radial path.

30. A coin dispensing apparatus according to claim 29, further comprising a further resiliently biased gating member also closing the coin outlet until the further gating member is engaged and opened by an edge of a coin being diverted; the coin then in use also being urged past the further gating member; the further gating member being provided adjacent the resiliently biased gating member and being arranged to prevent a second coin from being dragged into the coin outlet by the first coin.

31. A coin dispensing apparatus according to claim 29, wherein the coin outlet and the resiliently biased gating member both have a curved profile matching a circumferential curvature of the disk.

32. A coin dispensing apparatus according to claim 30, wherein the further gating member has a curved profile matching the curvature of the resiliently biased gating member.

33. A coin dispensing apparatus according to claim 29, wherein each gating member is arranged to be moved orthogonally to the movement of a coin being dispensed and comprises and angled face providing a coin engaging surface for translating the movement of the coin to lifting of the gate member.

34. A coin dispensing apparatus according to claim 29, wherein the gating member and/or further gating member are biased into position by at least one respective tensioned spring, and the gating member and/or further gating member are in use lifted against the action of the at least one tensioned spring by the leading edge of a coin being diverted.

35. A coin dispensing apparatus according to claim 34, wherein each gating member is held in its operating position by means of location pins along which the gating member can be lifted.

36. A coin dispensing apparatus according to claim 29, wherein the urging means includes an urging member, the disk comprises a plurality of coin transporting ribs which in use engage the coin to push the same against the urging member as the disk is being rotated.

37. A coin dispensing apparatus according to claim 36 wherein the disk comprises a base pate having a plurality of slots provided therein and the urging member comprises a plurality of upstanding ribs complementary to the plurality of slots.

38. A coin dispensing apparatus according to claim 29, wherein the urging means includes an urging member, the urging member protrudes into the disk by an amount equal to or less than the thickness of the thinnest coin that the apparatus is designed to dispense.

39. A coin dispensing apparatus according to claim 29, wherein the urging means includes an urging member, the urging member is spring biased into position and is arranged to be displaceable out of a coin engaging position in response to an abnormal force of a coin pushing thereon.

* * * * *